US008867318B2

(12) United States Patent
Suen

(10) Patent No.: US 8,867,318 B2
(45) Date of Patent: Oct. 21, 2014

(54) SUNRISE ALARM CLOCK

(76) Inventor: Chi Ming Suen, Kowloon (HK)

( * ) Notice: Subject to any disclaimer, the term of this patent is extended or adjusted under 35 U.S.C. 154(b) by 681 days.

(21) Appl. No.: 12/381,651

(22) Filed: Mar. 16, 2009

(65) Prior Publication Data

US 2010/0232261 A1 Sep. 16, 2010

(51) Int. Cl.
*G04C 19/00* (2006.01)
*G04G 11/00* (2006.01)

(52) U.S. Cl.
CPC ..... *G04G 11/00* (2013.01)
USPC ..... 368/83; 368/241; 368/244

(58) Field of Classification Search
USPC ..... 368/67, 68, 72, 73, 79, 82, 83
See application file for complete search history.

(56) References Cited

U.S. PATENT DOCUMENTS 3,798,889 A * 3/1974 Chadwick ..... 368/73
4,041,692 A * 8/1977 Marshino ..... 368/82
5,008,865 A 4/1991 Shaffer et al.
5,212,672 A * 5/1993 Loisch et al. ..... 368/79
5,253,228 A * 10/1993 Truett ..... 368/82
5,327,331 A * 7/1994 Roberts ..... 362/176
5,928,133 A * 7/1999 Halyak ..... 600/26
6,236,622 B1 5/2001 Blackman
7,280,439 B1 10/2007 Shaddox
7,465,085 B2 * 12/2008 McDonough ..... 368/98
2003/0095476 A1 * 5/2003 Mollicone et al. ..... 368/250
2003/0174586 A1 * 9/2003 Hon et al. ..... 368/84
2005/0248962 A1 11/2005 Searfoss et al.
2006/0064144 A1 3/2006 Chen et al.
2006/0133215 A1 * 6/2006 Gordon et al. ..... 368/79
2008/0129654 A1 * 6/2008 Bhavnani ..... 345/59

* cited by examiner

*Primary Examiner* — Amy Cohen Johnson
*Assistant Examiner* — Jason Collins
(74) *Attorney, Agent, or Firm* — Lee W. Tower

(57) ABSTRACT

An alarm clock including a rectangular base, a housing mounted on the base, an opaque portion on the front of the housing, a translucent portion on the front of the housing, a time display located on the front of the housing, and a plurality of light emitting diodes mounted inside the housing behind the translucent portion, wherein a first time prior to a set time for an alarm a first number of the plurality of light emitting diodes are lit, wherein on successive times prior to the set time for the alarm successive numbers of the plurality of light emitting diodes are lit, and wherein at the set time for the alarm the entire plurality of light emitting diodes are lit.

15 Claims, 5 Drawing Sheets

SUNRISE ALARM CLOCK

FIELD

This disclosure relates to alarm clocks, and in particular to alarm clocks that provide a sunrise simulation.

BACKGROUND

There are biological data that support the theory that the human body's internal time clock is set by natural light conditions, such as the sunrise and sunset. In particular, it is believed that one's internal clock may be set so that at sunrise a person wakes up. Of course, this only works if one sleeps in a room that does not block the natural light with drapes or other means. The natural light phenomenon has been recognized and there have been a number of designs proposed to provide a simulation of increasing light at sunrise. For example, U.S. Published Patent Application No. 2005_0248962 to Searfoss et al. describes a nightlight for phototherapy, which includes an alarm function with a wake up mode which may illuminate slowly or substantially immediately to full brightness. However, many users would prefer an alarm clock that is not also functioning as a nightlight in order to save cost. Also it may be desirable to increase the light intensity in steps.

Another such design is described by U.S. Published Patent Application No. 2006_0064144 to Chen et al. that describes a programmable multifunction table lamp for light therapy; however, this table lamp does not include an alarm function and is not an alarm clock. A lamp may function to provide an increase in light, but many would prefer to have a lamp that is a normal lamp and a separate alarm clock, which allows the user to select any desired lamp and save cost.

Yet another such design is U.S. Pat. No. 5,008,865 to Shaffer et al. that describes a light source with gradually changing intensity that is coupled to an alarm clock. In Shaffer, after the alarm clock wake-up signal is provided, the light intensity emitted by the lamp is slowly, smoothly and gradually increased. This device has the disadvantage of unnaturally awakening the sleeper because the light intensity is increased after the audible alarm. Also it may be more desirable to increase the light intensity in steps.

Another design is U.S. Pat. No. 6,236,622 to Blackman that describes a lamp that has an alarm clock built into the lamp. The lamp can be set to gradually increase the light intensity or sound intensity at a controllable time. While a user may wish to have a lamp that includes an alarm clock, it would be more desirable to have a separate alarm clock, which allows the user to select any desired lamp and reduces the cost of the alarm clock. Also, it may be more desirable to increase the light in steps rather than gradually.

Yet another design is U.S. Pat. No. 7,280,439 to Shaddox that describes a sunlight simulating alarm clock. In Shaddox an alarm clock incorporates a lighting system that, prior to the preset waking time, will emit a light that gradually increases in intensity as it changes the ultraviolet spectrum of light it emits, so as to simulate the rising sun. While Shaddox describes a gradual increase in light, it may be more desirable to increase the light in steps. Another disadvantage is that Shaddox describes a device that appears to be quite cumbersome for a nightstand.

What is needed is an alarm clock that does not have the disadvantages of the prior art while providing a simulated sunrise to gradually awaken the user and set the user's biological clock. The embodiments of the present disclosure answer these and other needs.

SUMMARY

In a first embodiment disclosed herein, an alarm clock comprises a rectangular base having a first horizontal axis and a second horizontal axis, a housing mounted on the base, the housing having a substantially oval shape having a front and a back, the housing having a first oval axis aligned with the first horizontal axis and a second oval axis aligned with a width of the housing and aligned with the second horizontal axis, an opaque portion on the front of the housing, a translucent portion on the front of the housing, a time display located on the front of the housing, and a plurality of light emitting diodes mounted inside the housing behind the translucent portion, wherein a first time prior to a set time for an alarm a first number of the plurality of light emitting diodes are lit, wherein on successive times prior to the set time for the alarm successive numbers of the plurality of light emitting diodes are lit, and wherein at the set time for the alarm the entire plurality of light emitting diodes are lit.

In another embodiment disclosed herein, an alarm clock comprises a substantially oval housing, an opaque portion on the front of the housing, a translucent portion on a front of the housing, wherein the opaque portion on the front of the housing and the translucent portion on the front of the housing are separated along an arcuate line, and a plurality of light emitting diodes mounted inside the housing behind the translucent portion, wherein a first time prior to a set time for an alarm a first number of the plurality of light emitting diodes are lit, wherein on successive times prior to the set time for the alarm successive numbers of the plurality of light emitting diodes are lit, and wherein at the set time for the alarm the entire plurality of light emitting diodes are lit.

These and other features and advantages will become further apparent from the detailed description and accompanying figures that follow. In the figures and description, numerals indicate the various features, like numerals referring to like features throughout both the drawings and the description.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Figure 1A:
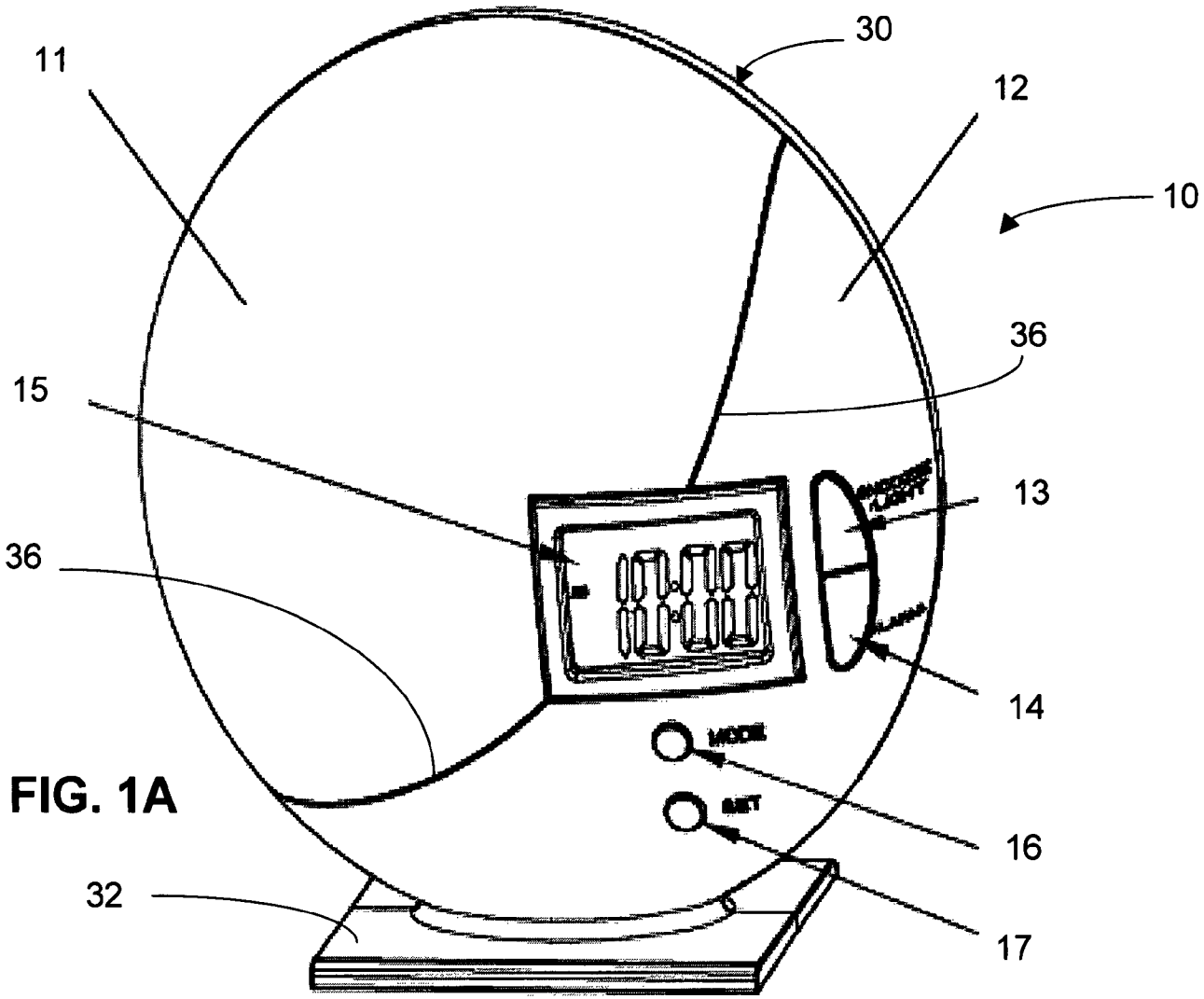
FIG. 1A shows a perspective front view of an alarm clock in accordance with the present disclosure.

Referring to FIG. 1A, a perspective front view of an alarm clock 10 is shown in accordance with the present disclosure. The alarm clock has an oval shaped housing 30 on a rectangular base 32. The front of the housing has a translucent area 11 and an opaque area 12. The translucent area 11 and the opaque area 12 are divided on the front of the housing by an arcuate line 36. Behind the translucent area 11 are a number of light emitting diodes (LEDs) (not shown in FIG. 1A), which are lit to provide a sunrise simulation as further described below. The front of the housing has a time display 15, which is intersected by the arcuate line 36, so that the time display 15 is partially in the opaque area 12 and partially in the translucent area 11. The time display 15 can be an LCD display. The front of the housing also has various controls including snooze/light and clock setting up button 13, alarm and clock setting down button 14, mode button 15 to select alarm clock or real time clock, and setting button 17. These buttons work in a manner well known in the art for setting the time on the clock and setting the time for an alarm.

Figure 1B:
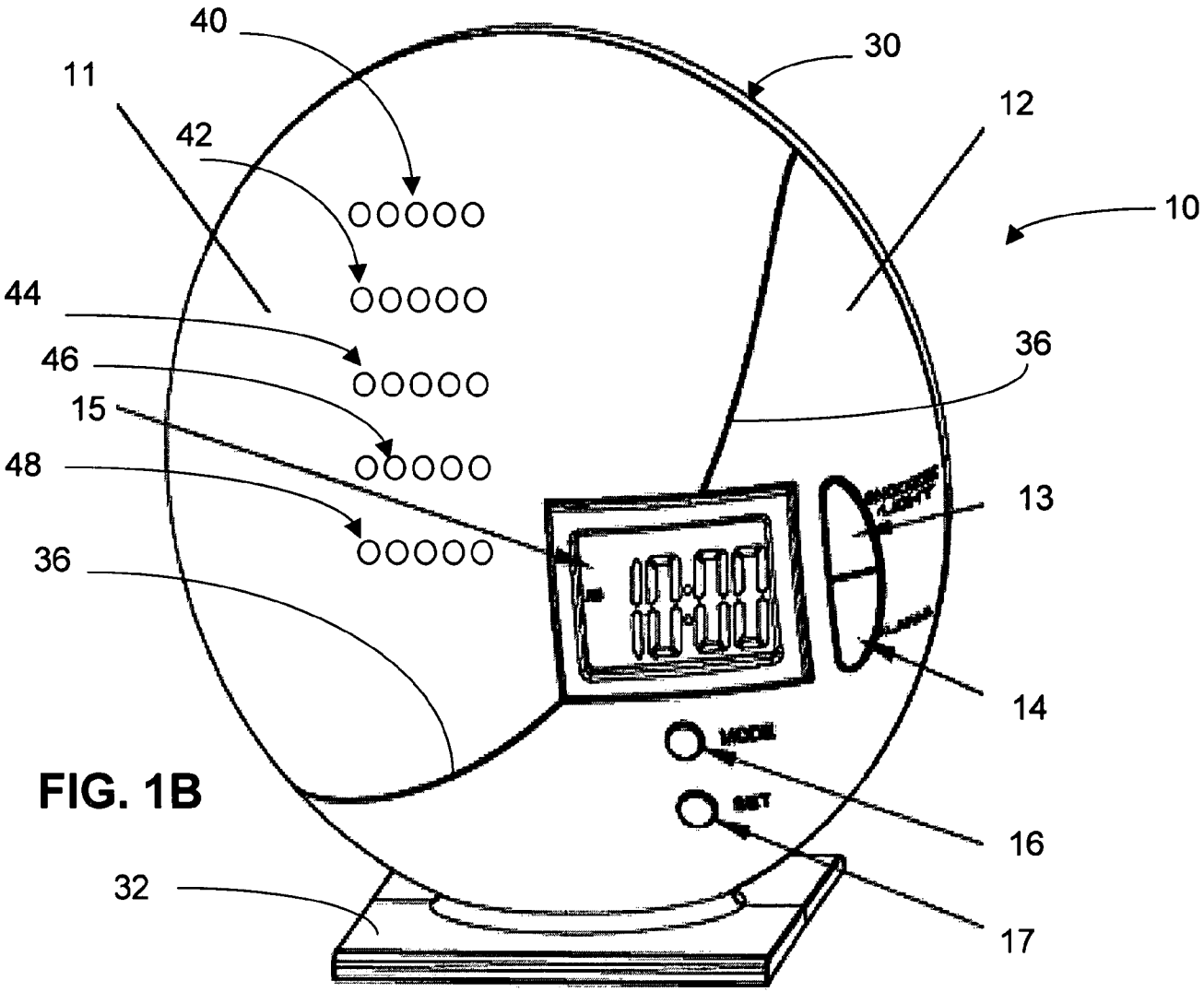
FIG. 1B shows a perspective front view of the alarm clock of FIG. 1A with the translucent area of the housing cut away to show the LEDs in accordance with the present disclosure.

FIG. 1B shows a perspective front view of the alarm clock of FIG. 1A with the translucent area 11 of the housing 30 cut away to show groups of LEDs 40, 42, 44, 46 and 48 in accordance with the present disclosure. Each LED group is shown as having 5 LEDs but it should be understood that the number in each group may be more than or less than five.

Figure 2:
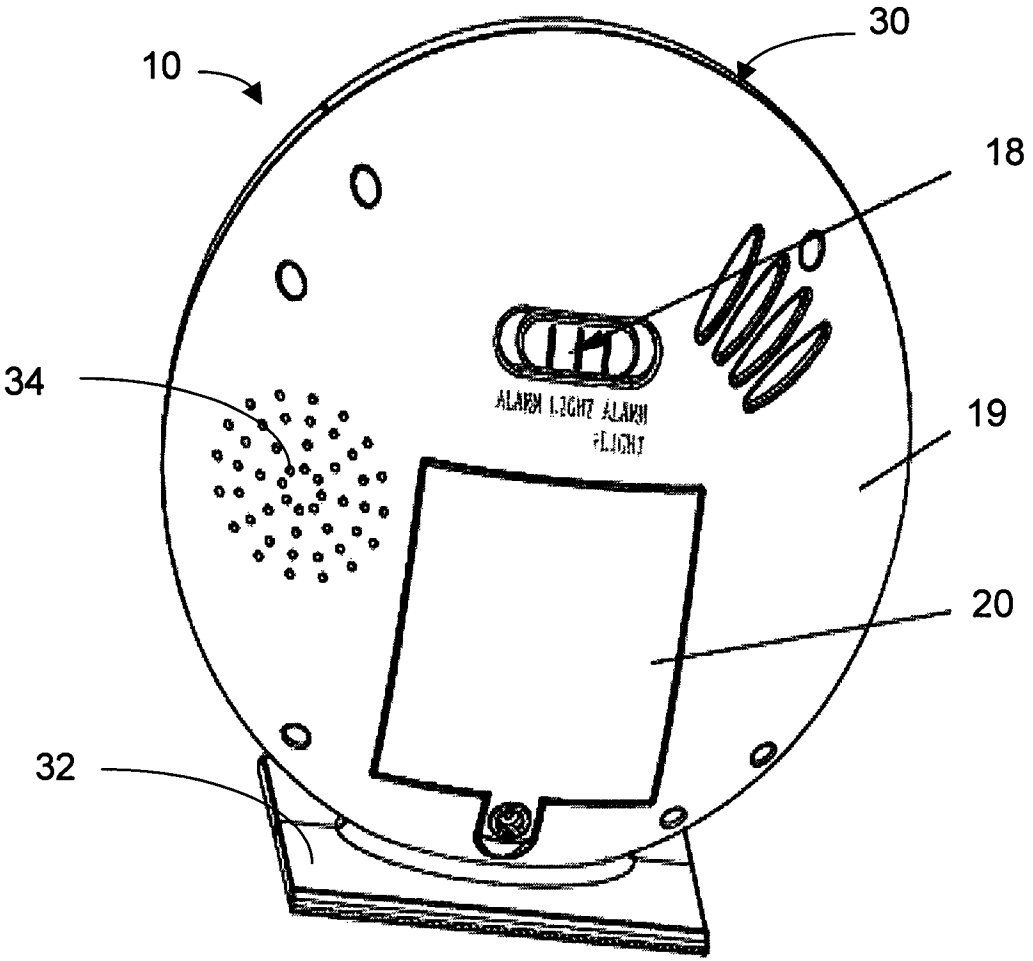
FIG. 2 shows a perspective back view of an alarm clock in accordance with the present disclosure.

FIG. 2 shows a perspective back view of the alarm clock 10. The back side 19 of the housing 30 is generally opaque. A switch 18 is provided to enable the user to select an alarm that is an audible alarm only, a sunrise simulating light display only, or an audible alarm plus a sunrise simulating light display. A speaker 34 is provided for sounding an audible alarm. The alarm clock 10 may be battery powered by batteries hidden by battery cover 20.

Figure 3:
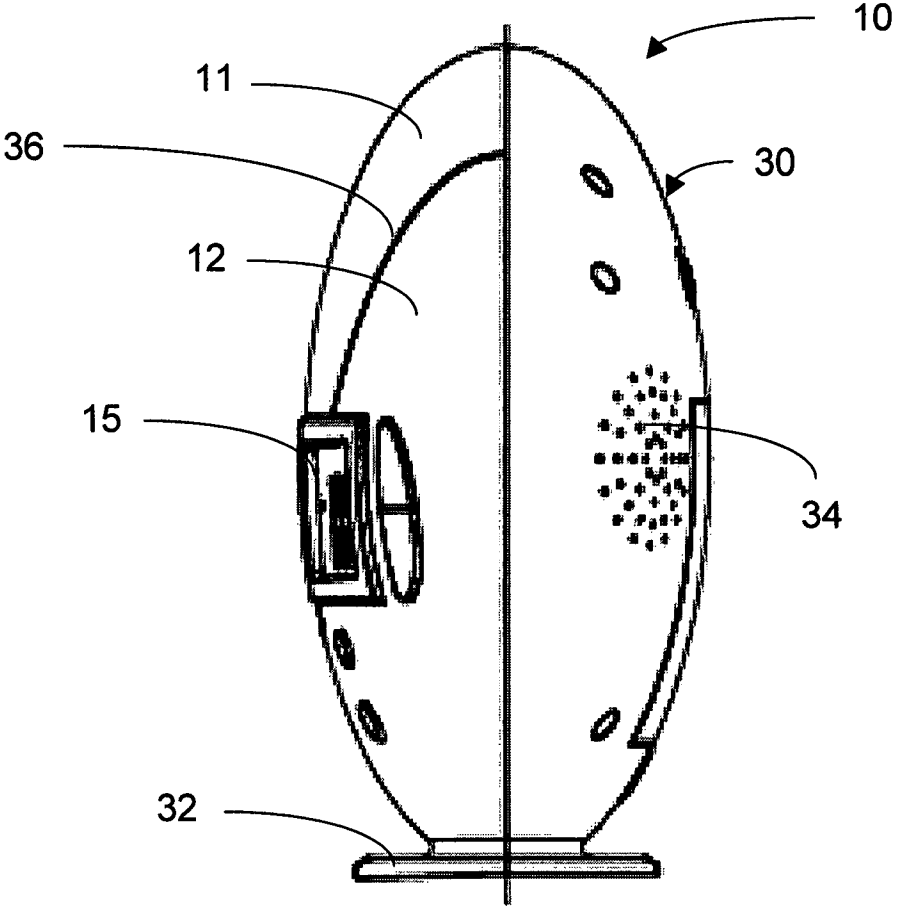
FIG. 3 shows a side view of an alarm clock in accordance with the present disclosure.

FIG. 3 shows a side view of the alarm clock 10 in accordance with the present disclosure. As shown the oval housing 30 is preferably vertically aligned with base 32 and the width (front to back) of the housing 30 is less than the height of the housing 30 from the base 32.

Figure 4B:
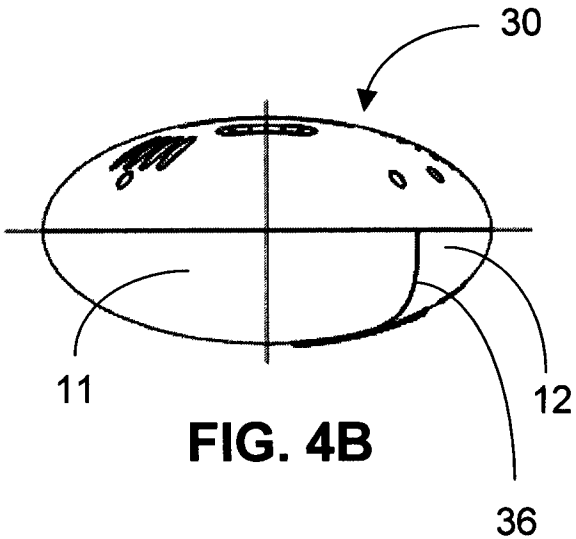
FIGS. 4A and 4B show a top view and a bottom view of an alarm clock in accordance with the present disclosure.
Figure 4A:
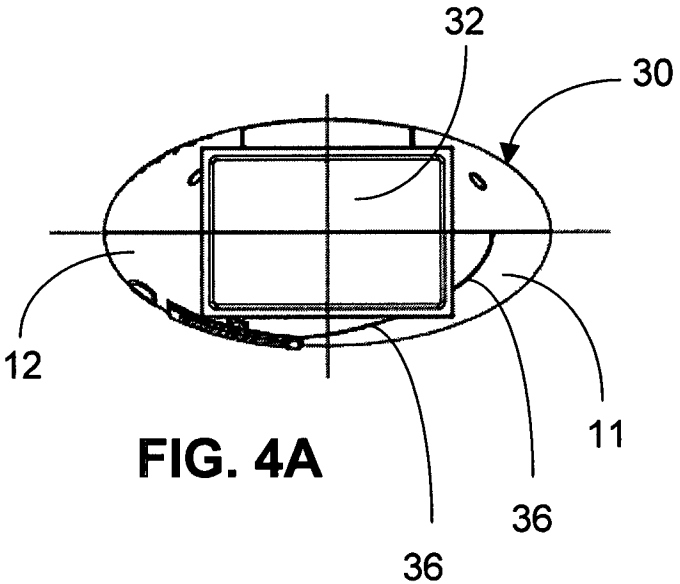

FIGS. 4A and 4B show a top view and a bottom view of the alarm clock 10 in accordance with the present disclosure. FIG. 4A shows that the oval housing 30 is aligned with the axes of the rectangular base 32. The housing 30 has a first oval axis aligned with one longitudinal axis of the base 32 and a second oval axis aligned with a width of the housing 30 and aligned with the other longitudinal axis of the base 32. As is evident in FIG. 3 the vertical axis of the oval housing 30 is aligned to be perpendicular to the plane of the rectangular base 32.

When a user sets the alarm clock 10, the user via switch 18 is able to select an alarm that is an audible alarm only, a sunrise simulating light display only, or an audible alarm plus a sunrise simulating light display. The audible alarm if selected goes off at the time set for the alarm.

If the user selects a sunrise simulating light display mode, then a group of LEDs, such as group 40, are turned on 20 minutes prior to the time set for the alarm. Then another group of LEDs, such as group 42, are also turned on 15 minutes prior to the time set for the alarm. At 10 minutes prior to the time set for the alarm another group of LEDs, such as group 44, are turned on. At 5 minutes prior to the time set for the alarm yet another group of LEDs, such as group 46, are turned on. Finally, at the time set for the alarm yet another group of LEDs, such as group 48 are turned on. Thus, the sunrise simulation light display increases the intensity of the light in steps until all of the LEDs are lit. The LEDs remain lit for about 1 minute after the time set for the alarm and then are turned off.

If the alarm mode is set to include an audible alarm, then the audible alarm also is turned on at the time set for the alarm and turns off 1 minute later.

In another embodiment, the start time prior to the set time for the alarm for lighting the first group of LEDs is settable. The time between lighting each successive group of LEDs may also be settable. The time after the time set for the alarm and the LEDs to remain lit may also be set by a user to be less than or more than one minute.

In another embodiment, the number of LEDs to light in each group of LEDs is user settable. This allows the user to set the brightness of the sunrise simulating light display.

Having now described the invention in accordance with the requirements of the patent statutes, those skilled in this art will understand how to make changes and modifications to the present invention to meet their specific requirements or conditions. Such changes and modifications may be made without departing from the scope and spirit of the invention as disclosed herein.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step(s) of . . . . "

What is claimed is:

1. An alarm clock comprising:

a rectangular base having a first horizontal axis and a second horizontal axis;

a housing mounted on the base, the housing having a substantially oval shape having a front and a back, the housing having a first oval axis aligned with the first horizontal axis and a second oval axis aligned with a width of the housing and aligned with the second horizontal axis;

an opaque portion on the front of the housing;

a translucent portion on the front of the housing;

a time display located on the front of the housing; and a sunrise simulating light display adapted to simulate a sunrise, the sunrise simulating light display consisting of:

a plurality of groups of light emitting diodes mounted inside the housing behind the translucent portion, wherein each group of light emitting diodes of the plurality of groups of light emitting diodes has the same number of light emitting diodes, and each light emitting diode in each group has a same light intensity when turned on;

wherein the number of light emitting diodes in each group of the plurality of groups is greater than one;

wherein at a first time prior to a set time for an audible alarm a first group of the plurality of groups of light emitting diodes is turned on to simulate a brightness of a first time of a sunrise;

wherein after the first time and at a second time prior to a set time for the audible alarm a second group of the plurality of light emitting diodes is turned on, and the first group of the plurality of groups of light emitting diodes stays turned on to simulate a brightness of a second time of a sunrise;

wherein after the second time and on each set successive time prior to the set time for the audible alarm an additional group of the plurality of groups of light emitting diodes is turned on, and previously turned on groups of the plurality of groups of light emitting diodes stay turned on to simulate a brightness of each successive time of a sunrise; and wherein at the set time for the audible alarm the plurality of groups of light emitting diodes are all turned on to simulate a brightness of a risen sun.

2. The alarm clock of claim 1 wherein a vertical axis of the housing is aligned vertically to the base.

3. The alarm clock of claim 1 wherein the width of the housing is less than a height of the housing from the base.

4. The alarm clock of claim 1 wherein the opaque portion on the front of the housing and the translucent portion on the front of the housing are separated by an arcuate line.

5. The alarm clock of claim 4 wherein the time display is intersected by the arcuate line separating the opaque portion on the front of the housing and the translucent portion on the front of the housing.

6. The alarm clock of claim 1 wherein:

the plurality of groups of light emitting diodes is 5 groups;

the first time is 20 minutes prior to the set time for the audible alarm;

wherein the second time is 15 minutes prior to the set time for the audible alarm; and wherein each set successive time is 10, 5 and 0, respectively, minutes prior to the set time for the audible alarm.

7. The alarm clock of claim 6 wherein at the set time for the alarm an audible alarm is sounded.

8. The alarm clock of claim 7 wherein one minute after the set time for the audible alarm, the audible alarm and the plurality of groups of light emitting diodes are turned off.

9. The alarm clock of claim 1:

wherein the first time, the second time, and each set successive time are settable.

10. An alarm clock comprising:

a substantially oval housing;

an opaque portion on the front of the housing;

a translucent portion on a front of the housing, wherein the opaque portion on the front of the housing and the translucent portion on the front of the housing are separated along an arcuate line; and a sunrise simulating light display adapted to simulate a sunrise, the sunrise simulating light display consisting of:

a plurality of groups of light emitting diodes mounted inside the housing behind the translucent portion, wherein each group of light emitting diodes of the plurality of groups of light emitting diodes has the same number of light emitting diodes, and each light emitting diode in each group has a same light intensity when turned on;

wherein the number of light emitting diodes in each group of the plurality of groups is greater than one;

wherein at a first time prior to a set time for an audible alarm a first group of the plurality of groups of light emitting diodes is turned on to simulate a brightness of a first time of a sunrise;

wherein after the first time and at a second time prior to a set time for the audible alarm a second group of the plurality of light emitting diodes is turned on, and the first group of the plurality of groups of light emitting diodes stays turned on to simulate a brightness of a second time of a sunrise;

wherein after the second time and on each set successive time prior to the set time for the audible alarm an additional group of the plurality of groups of light emitting diodes is turned on, and previously turned on groups of the plurality of groups of light emitting diodes stay turned on-to simulate a brightness of each successive time of a sunrise; and wherein the first time, the second time, and each set successive time are settable; and wherein at the set time for the audible alarm the plurality of groups of light emitting diodes are all turned on to simulate a brightness of a risen sun.

11. The alarm clock of claim 10 wherein:

the plurality of groups of light emitting diodes is 5 groups;

wherein the first time is 20 minutes prior to the set time for the audible alarm;

wherein the second time is 15 minutes prior to the set time for the audible alarm;

wherein each set successive time is 10, 5 and 0, respectively, minutes prior to the set time for the audible alarm; and wherein each group has the same number of light emitting diodes.

12. The alarm clock of claim 10 wherein one minute after the set time for the audible alarm the plurality of groups of light emitting diodes and the audible alarm are turned off.

13. An alarm clock comprising:

a translucent portion on the front of the alarm clock;

a time display located on the front of the alarm clock; and a sunrise simulating light display adapted to simulate a sunrise, the sunrise simulating light display consisting of:

a plurality of groups of light emitting diodes mounted inside the housing behind the translucent portion, wherein each group of light emitting diodes of the plurality of groups of light emitting diodes has the same number of light emitting diodes, and each light emitting diode in each group has a same light intensity when turned on;

wherein the number of light emitting diodes in each group of the plurality of groups is greater than one;

wherein at a first time prior to a set time for an audible alarm a first group of the plurality of groups of light emitting diodes is turned on to simulate a brightness of a first time of a sunrise;

wherein after the first time and at a second time prior to a set time for the audible alarm a second group of the plurality of light emitting diodes is turned on, and the first group of the plurality of groups of light emitting diodes stays turned on to simulate a brightness of a second time of a sunrise;

wherein after the second time and on each set successive time prior to the set time for the audible alarm an additional group of the plurality of groups of light emitting diodes is turned on, and previously turned on groups of the plurality of groups of light emitting diodes stay turned on-to simulate a brightness of each successive time of a sunrise; and wherein the first time, the second time, and each set successive time are settable; and wherein at the set time for the audible alarm the plurality of groups of light emitting diodes are all turned on to simulate a brightness of a risen sun.

14. The alarm clock of claim 13:

the plurality of groups of light emitting diodes is 5 groups;

wherein the first time is 20 minutes prior to the set time for the audible alarm;

wherein the second time is 15 minutes prior to the set time for the audible alarm;

wherein each set successive time is 10, 5 and 0, respectively, minutes prior to the set time for the audible alarm; and wherein each group has the same number of light emitting diodes.

15. The alarm clock of claim 14 wherein one minute after the set time for the audible alarm the plurality of groups of light emitting diodes are turned off.

* * * * *